US005209269A

United States Patent [19]

Macho

[11] Patent Number: 5,209,269

[45] Date of Patent: May 11, 1993

[54] POSITIVE ECCENTRIC DOBBY

[75] Inventor: Helmut Macho, Konstanz, Fed. Rep. of Germany

[73] Assignee: Sulzer Brothers Limited, Winterthur, Switzerland

[21] Appl. No.: 849,113

[22] Filed: Mar. 9, 1992

[30] Foreign Application Priority Data

May 7, 1991 [CH] Switzerland ..... 01365/91

[51] Int. Cl.[5] ..... D03C 1/14

[52] U.S. Cl. ..... 139/66 R; 139/79

[58] Field of Search ..... 139/71, 79, 81, 66 R, 139/69

[56] References Cited

U.S. PATENT DOCUMENTS

| | | | |
|---|---|---|---|
| 3,889,720 | 6/1975 | Porter | 139/66 R |
| 3,946,766 | 3/1976 | Amigves | 139/66 R |
| 4,984,607 | 1/1991 | Beyaert | 139/79 |

FOREIGN PATENT DOCUMENTS

| | | |
|---|---|---|
| 2317395 | 4/1977 | France . |
| 2425490 | 12/1979 | France . |
| 255931 | 1/1949 | Switzerland . |
| 260546 | 7/1949 | Switzerland . |

*Primary Examiner*—Andrew M. Falik

*Attorney, Agent, or Firm*—Townsend and Townsend

[57] ABSTRACT

A positive eccentric dobby having a rigidly mounted roller lever shaft with minimal clearance, on which pivoted roller levers are disposed, which transmit the movement to the heald frames via coupled connecting rods, reversing levers and rods. A camshaft with eccentrically disposed cam discs is rigidly mounted on a displaceable carriage. In the state where there is a clearance between the rollers and the cam discs, one or more stops swivel the roller levers so that the heald shafts can be coordinated in several preset positions. When there is no clearance between rollers and cam discs, a jamming block having a motorized driving device fixes the position of the carriage with a stop.

9 Claims, 2 Drawing Sheets

POSITIVE ECCENTRIC DOBBY

BACKGROUND OF THE INVENTION

The invention relates to a positive eccentric dobby for driving the heald shafts of a loom having eccentrically disposed cam discs attached to a camshaft, which drives pivoted roller levers on a rigidly mounted roller lever shaft with minimal clearance.

A positive eccentric dobby for looms having a heald shaft coordination device is shown in Swiss Patent Specification CH 260 546. A camshaft used to drive the heald shafts and having associated cam discs can be displaceably or tiltably moved, so that when there is a clearance between the cam discs and rollers, the heald shafts can return to a starting position because their dead weight produces a coordination of the heald shafts; i.e. places all heald shafts in the same position. A single position for the coordination of the heald shafts does not meet the requirements of the various operating sequences of a loom, such as, for example, the cleaning of a weft duct, or various operating states, such as, for example, the disengagement of the warp threads.

SUMMARY OF THE INVENTION

The invention offers a solution to this problem. The object of the invention is to achieve heald shaft coordination in several defined positions. The object is achieved by the invention in that the camshaft is rigidly mounted on a carriage, in that the contact between rollers and cam discs can be eliminated by the displacement of the carriage and at least one stop acting on the roller levers produces a coordination of the heald shafts in any position. The invention has various advantages. Positively all heald shafts in the same coordinated positions can be controlled automatically. Therefore in the coordinated position the warp threads can be raised and lowered parallel to one another. The coordination of the heald shafts in the center shed disengages the warp threads when the loom has stopped, for example. The coordination of the heald shafts in the bottom shed is advantageous during cleaning or when changing the warp. The fixed mounting of the roller lever shaft, which does not permit much clearance, and also of the entire shaft assembly, results in the exact transmission of motion, as a result of which higher speeds can be achieved. The coordination of the shafts does not require adjustments in the linkage for the shaft assembly and its mounting. Therefore no distortions occur in the shaft position either. The fixed, rigid mounting reduces opportunities for adjustment because of operational influences or assembly errors.

DESCRIPTION OF THE PREFERRED EMBODIMENTS

Figure 1:
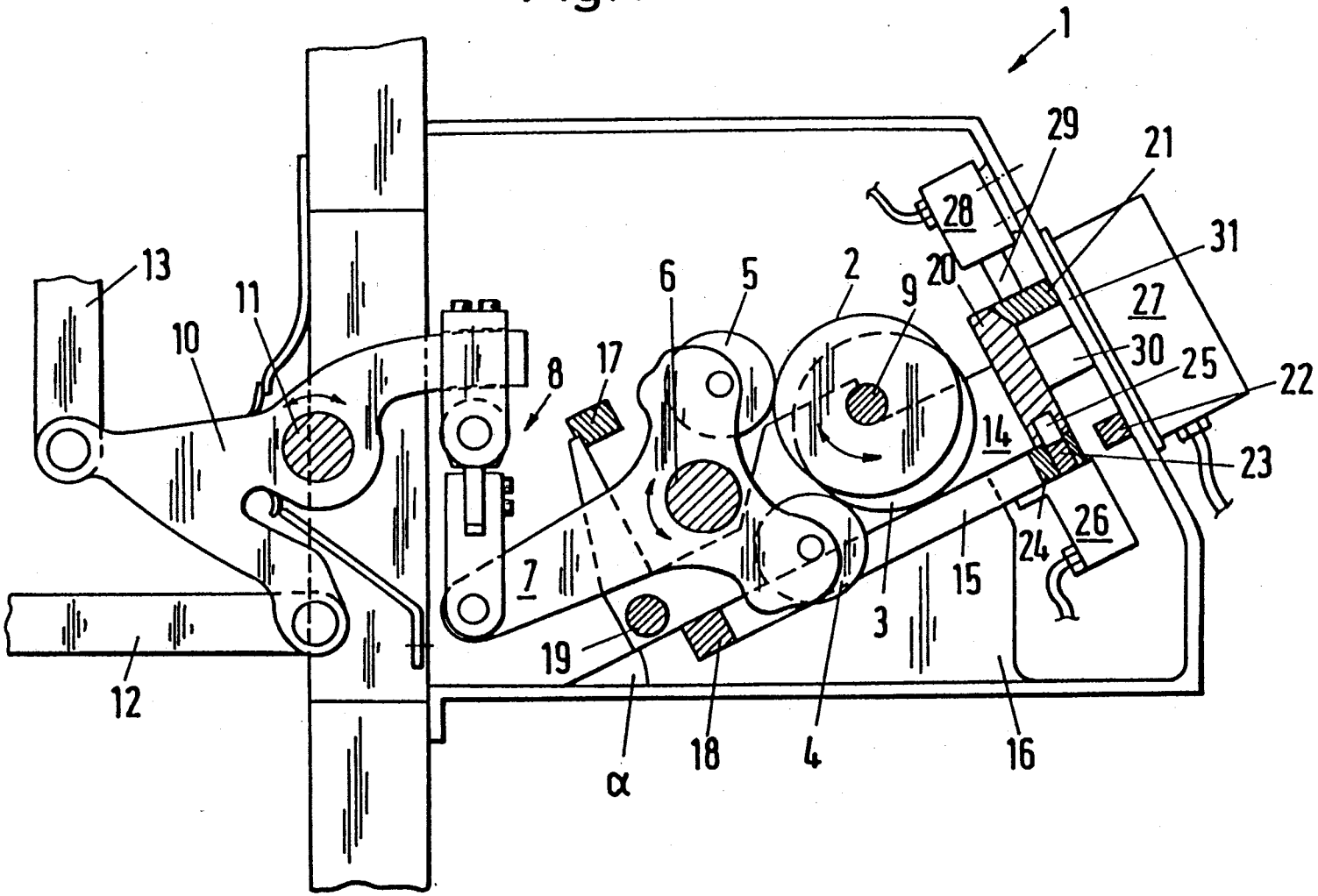
FIG. 1 shows a cross-section through the eccentric dobby when the clearance between rollers and camshafts is eliminated.

In FIG. 1 the invention shows a positive eccentric dobby having a rigidly mounted roller lever shaft 6 with minimal clearance, on which pivoted roller levers 7 are disposed, which transmit the movement to the heald frames via coupled connecting rods 8, reversing lever 10 and rods 12, 13. The camshaft 9 having the eccentrically disposed cam discs 2, 3 is rigidly mounted on a displaceable carriage 14. In the state where there is a clearance between rollers 4, 5 and cam discs 2, 3, a stop 17 and/or stop 18 swivel the roller levers so that the coordination of the heald shafts can be preset in several positions.. When there is no clearance between rollers 4, 5 and cam discs 2, 3, a jamming block 21 having a motorized driving device 28 fixes the position of the carriage 14 via a stop 20.

The jamming block 21 is connected via a rod 29 to a motorized driving device 28. The various positions of the heald shaft coordination can be automatically controlled with the two motorized driving devices 26 and 27. The motorized driving device 27 moves the carriage 14 with all the components located thereon, in particular the camshaft 9 with the cam discs 2, 3 and also the stop 17 acting on the roller lever 7, via rod 30. Normally an eccentric dobby simultaneously drives several heald frames, so that several roller levers 7 are parallel next to one another on the roller lever shaft 6, with each roller lever 7 driving a heald frame via separate rods 8, 12, 13 and reversing lever 10. Similarly several pairs of cam discs 2, 3 are parallel to one another on the camshaft 9, with one cam disc pair 2, 3 driving a roller lever 7. Transverse rigidity is imparted to the carriage at right angles to its direction of movement by the cross struts 19, the stop 20 and further components, which are not shown. The stop 17 is constructed as cross struts throughout and therefore acts in the same way on all roller levers 7.

The stop 18 is a part of a further carriage 15, which can be coupled and uncoupled to the carriage 14 with coupling means, a journal 23 driven by a motor 26 and also a guide bore 25.

Figure 2:
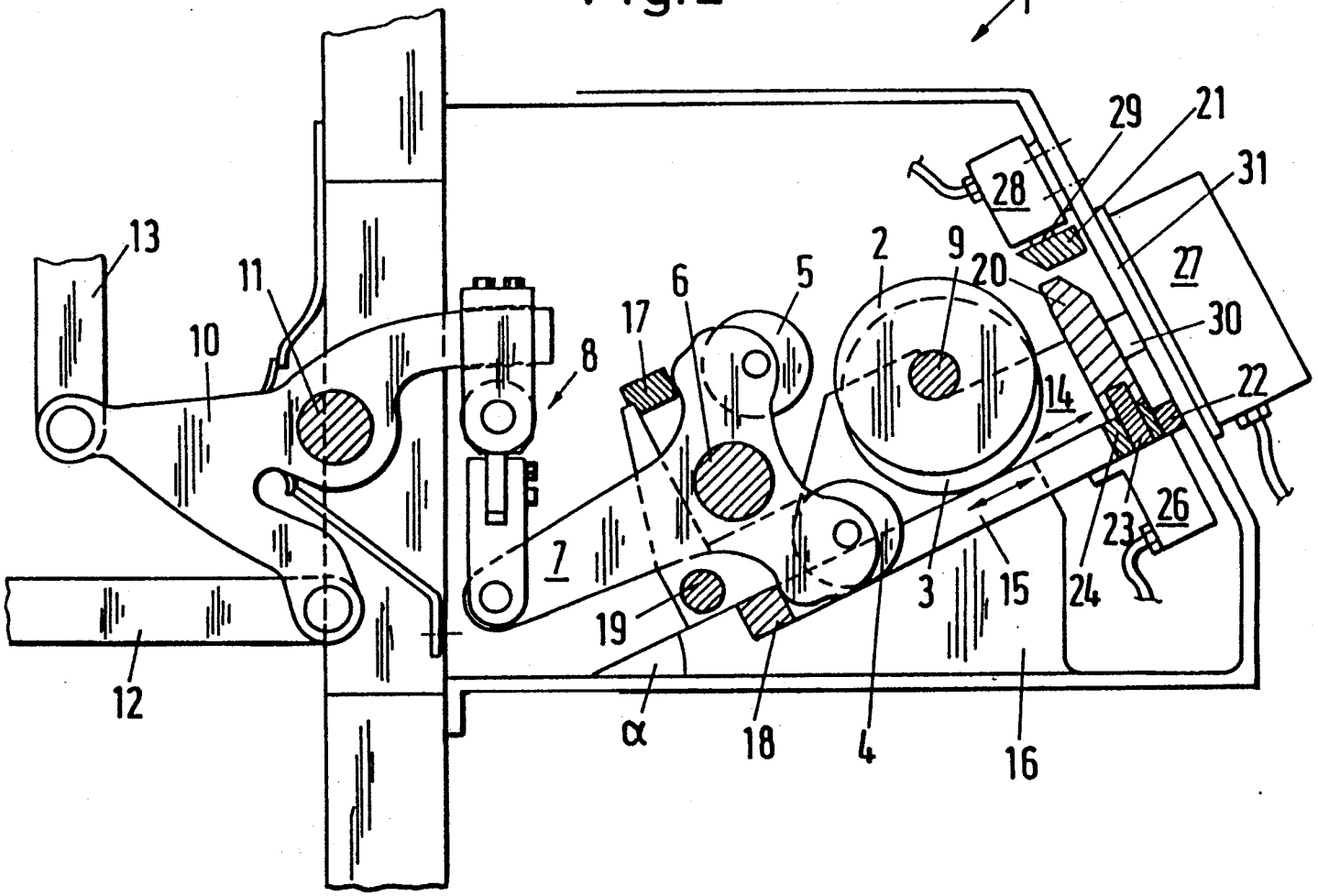
FIG. 2 shows a cross-section through the eccentric dobby with a clearance between rollers and cam discs.

FIG. 2 shows a cross-section of the eccentric dobby with the coordination of the heald shafts in the middle shed. Starting from the carriage position shown in FIG. 1, the carriage 15 is coupled to the carriage 14 by the journal 23. The jamming of the carriage 14 by the jamming block 21 is eliminated by the driving device 28. Consequently the carriages 14 and 15 are displaced in a straight line by the motorized driving device 27, with the distance between roller lever shaft 6 and camshaft 9 increasing until the two stops 22 and 24 meet. As shown in FIG. 2, the rollers 4, 5 and cam discs 2, 3 no longer touch, and for this purpose the roller levers 7 are fixed by stops 17 and 18 in a defined swivelling position.

The eccentric dobby specified by the invention permits one further position of the coordination of the heald shafts. If the carriage 15 is uncoupled from the carriage 14, then the distance between the roller lever shaft 6 and the camshaft 9 can be further increased by means of the driving device 27 until the carriage 14 touches the housing wall 31 with the stop 20. At the same time the roller levers 7 are swivelled by the stop 17 so that a coordination of the heald shafts is produced in the bottom shed. The stop 18 can be used to fix the swivelling position of the roller levers 7.

In the state where there is a clearance between rollers 4, 5 and cam discs 2, 3, the heald shafts automatically move because of their dead weight and the opposing tension of the warp threads into a neutral position and consequently achieve an approximate coordination of the heald shafts. With an automatic coordination of the heald shafts in the region of the neutral position it is advantageous to fix the roller levers 7 in a defined swivelling position by the two stops 17 and 18 so as to achieve an exact coordination. For positions for the coordination of heald shafts outside the region of the neutral position, a single stop acting on the roller levers 7 may suffice for an exact coordination of the heald shafts. If no warp threads are present, the heald shafts fall into a bottom shed position when there is a clearance between rollers 4, 5 and cam discs 2, 3, with the stop 18 effecting a coordination of the heald shafts.

An elimination of the clearance between rollers 4, 5 and cam discs 2, 3 may actively be produced by the motorized driving device 27. The elimination of the clearance may also occur passively by the angle alpha between the plane of movement of the carriage and the horizontal being selected so that the dead weight of the carriage 14 and also of its components entrained therewith is sufficient to effect the elimination of the clearance.

The main drive of the camshaft 9 remains connected to the camshaft 9 in every position of the carriage, e.g. by a spur gear drive or a belt drive, so that, after the clearance has been eliminated between rollers 4, 5 and cam discs 2, 3, the camshaft 9 and consequently the roller levers 7 assume the same position as before the coordination of the heald shafts.

In the present exemplified embodiment the carriage 14 moves in a straight line in one plane on the carriage support 16. However non-linear movements of the carriage 14 are also suitable for producing a clearance between rollers 4, 5 and cam discs 2, 3. Additional shaft coordination positions can be achieved by stop 17 and/or stop 18 assuming different positions, e.g. with the help of a motorized driving device acting directly on the stops or, for example, by additional carriages using to the operating principle of carriage 15.

One side of the shaft is directly driven with the reversing lever 10 rotating around the axis 11 via the lifter rod 13. The additional intermediate lever which is normally used is dispensed with. Moreover the roller lever is designed so it is small and has a low mass and is rigidly mounted in a fixed position. Thanks to these constructional measures the eccentric dobby specified by the invention is suitable for very high rotational speeds. The energy consumption can be reduced and the level of efficiency can be increased. The eccentric dobby specified by the invention is suitable both for airjet looms and also for rapier and gripper shuttle looms.

The camshaft 9 and the carriage 14 are disposed in the eccentric dobby so that the camshaft 9 is easily accessible and can be replaced without difficulty.

What is claimed is:

1. A positive eccentric dobby for driving heald shafts of a loom comprising a movably mounted carriage, a camshaft rigidly mounted on the carriage, a rigidly mounted roller lever shaft, roller levers pivotally carried on the roller lever shaft, rollers mounted on the roller levers, eccentrically disposed cam discs carried on the camshaft for moving the pivotable roller levers on the roller lever shaft by contacting the rollers, means for displacing the carriage to disengage the cam discs and the rollers and therewith the roller levers, and at least one stop device including stop means for adjustably acting on the roller levers for coordinating the position of the heald shafts.

2. A positive eccentric dobby according to claim 1 including means for moving the carriage along a path which is inclined relative to the horizontal at an angle of inclination selected to enable the carriage to move gravitationally along said inclined path until a clearance between the cam discs and the rollers is eliminated.

3. A positive eccentric dobby according to claim 2 wherein said path lies in an inclined plane.

4. A positive eccentric dobby according to claim 1 including a motorized driving device for eliminating a clearance between the cam discs and the rollers.

5. A positive eccentric dobby according to claim 1 including a jamming block and a motorized driving device operatively coupled with the jamming block for positioning the carriage so that there is no clearance between the rollers and the cam discs.

6. A positive eccentric dobby according to claim 1 wherein the stop device includes a motor for moving the stop means relative to the roller levers to fix the roller levers in predetermined positions in which the heald shafts are in coordinated positions.

7. A positive eccentric dobby according to claim 1 wherein the stop means includes a stop member rigidly connected to the carriage.

8. A positive eccentric dobby according to claim 1 including a second carriage, and means for coupling and uncoupling the second carriage from the first-mentioned carriage comprising a releasable connector for coupling and uncoupling the carriages and a motor for operating the connector.

9. A loom comprising heald shafts and a positive eccentric dobby for driving the heald shafts including a movably mounted carriage, a camshaft rigidly mounted on the carriage, a rigidly mounted roller lever shaft, roller levers pivotally carried on the roller lever shaft, rollers mounted on the roller levers, eccentrically disposed cam discs carried on the camshaft for moving the pivotable roller levers on the roller lever shaft by contacting the rollers, means for displacing the carriage to disengage the cam discs and the rollers and therewith the roller levers, and at least one stop device including stop means for adjustably acting on the roller levers for coordinating the position of the heald shafts.

* * * * *